United States Patent [19]

Wadensten

[11] 3,932,057

[45] *Jan. 13, 1976

[54] NOISELESS AIR-ACTUATED TURBINE-TYPE VIBRATOR WITH BLADES ARRANGED IN A SIDEWARDLY EXTENDING ANNULAR PATTERN

[76] Inventor: Theodore S. Wadensten, P.O. Box 8 - Stilson Road, Wyoming, R.I. 02898

[ * ] Notice: The portion of the term of this patent subsequent to Mar. 11, 1992, has been disclaimed.

[22] Filed: May 8, 1974

[21] Appl. No.: 467,915

[52] U.S. Cl. ..... 415/53 T; 259/DIG. 43; 415/119; 415/213

[51] Int. Cl.[2] ..... B06B 1/16

[58] Field of Search..... 259/1 R, DIG. 43; 415/119, 415/202, 213 T, 503

[56] References Cited

UNITED STATES PATENTS

| | | | |
|---|---|---|---|
| 589,350 | 8/1897 | Holzhauser | 415/202 |
| 2,911,189 | 11/1959 | von Ohain | 415/202 |
| 2,960,316 | 11/1960 | McKellar | 250/1 R |
| 3,737,248 | 6/1973 | Abraham | 415/202 X |

*Primary Examiner*—Richard E. Aegerter
*Assistant Examiner*—Michael H. Thaler
*Attorney, Agent, or Firm*—Ralph R. Roberts

[57] ABSTRACT

This invention pertains to turbine-type vibrators in which the rotor member has the blade portions arranged in an annular pattern. The blades extend substantially at right angles to the plane of rotation of the rotor. The blades are carried on and extend from the side of the rotor and may have one or two parallel rows. When two rows of blades are provided one row is arranged on each side of the rotor and a divider is preferably provided between the blades. Each annular grouping has its own inlet and its own outlet.

12 Claims, 14 Drawing Figures

28
34
36
39
24
38
68
40
44
42
30
20

70
50
52
56
54
62
64
66
60
58
76
78
79
80
62
20
47
2
28
22
26
24
46
30
2
70
32

200
201
230
231
232
74
80
60
76
78
72
79
102
99
70
96
32
104
54
62
56
66
90
47
92
94
46
100
106
108
98
110
112

(13) 12
150
154
156
157
158
144
124
130
140
142
148
180
162
160
181
170
173
164
172
178
176
174
70
54
62
56
66
60
78
79
80
152

NOISELESS AIR-ACTUATED TURBINE-TYPE VIBRATOR WITH BLADES ARRANGED IN A SIDEWARDLY EXTENDING ANNULAR PATTERN

CROSS REFERENCE TO RELATED APPLICATIONS

The turbine-type vibrators of this application utilize the same general concepts as are described and claimed in my copending applications, Ser. No. 355,681 now U.S. Pat. No. 3,870,282 filed Apr. 30, 1973 and entitled, "Noiseless Air-Actuated Turbibe-Type Vibrator" and my application, Ser. No. 430,082 filed Jan. 2, 1974 and entitled, "Noiseless Air-Actuated Turbine-Type Vibrator with Muffler."

BACKGROUND OF THE INVENTION

1. Field of the Invention

In accordance with the classification of art as established in the U.S. Patent Office this invention is found in the general Class entitled, "Agitating" (Class 259) and the subclass therein entitled, "miscellaneous" (subclass 1) which has been further identified in this subclass as "1*r*" and "Digest 43". The method of making a vibration apparatus as in the embodiment shown is found in the general Class entitled, "Metal Working" (Class 29) and the subclass therein of "impellers" (subclass 156.8).

2. Description of the Prior Art

Air turbines are not new and making the rotor with an eccentric weight is also well known as seen in U.S. Pat. No. 3,074,151 to KROECKEL as issued on Jan. 22nd, 1963. Another patent using the same general concept includes U.S. Pat. No. 2,875,988 to WYSONG as issued on Mar. 3rd, 1959. Other air driven vibrators also generally used include balltype vibrators as seen in U.S. Pat. to PETERSON, No. 2,793,009 as issued on May 21st, 1957 and No. 2,917,290 as issued on Dec. 15th, 1959. In these apparatus as well as others known to the applicant the noise levels at and during normal operation exceed the tolerance levels for continuous duty operation ie. 85 db) as established by the Federal Occupational Safety and Health Act of 1970.

The turbine-type pneumatic vibrator of this invention and the others noted in the cross referenced applications, as reduced to practice and extensively tested and used in commercial installations, operate substantially continuously at noise levels well below the established 85 db and with the associated muffler operate at levels of 60 to 70 db. This, of course, falls well within the safety limits of this federal standard. In sharp contrast to this "quiet" vibrator is the ball-and-race vibrator now and for the past several years in extensive use. This ball-and-race vibrator is shown and described in U.S. Pat. No. 2,793,009 as issued on May 21st, 1957 and No. 2,917,290 as issued on Dec. 15th, 1959 both to PETERSON. The noise level usually found in the installations employing these ball-and-race vibrators is often in excess of 100 db. This noise level for periods of eight or more hours, of course, is unacceptable.

In the present invention the size of the rotor, the number and depth of teeth used therewith and the normal operating range of air pressure used to drive the vibrator are closely related factors. The air turbine of this invention uses a close limit control of these factors to successfully insure that the safe requirements for a "quiet" operation of the vibration apparatus is met or exceeded.

The turbine members in the present invention are formed with the turbine blades in an annular or ring-like pattern and with the blades extending transversely from and normal to the side of the turbine rotor. The housing associated therewith has its inlet and outlet arranged to direct the flow to and from the chamber as a bifurcated or diverted flow.

SUMMARY OF THE INVENTION

The present invention may be summarized at least in part with reference to its objects.

It is an object of this invention to provide, and it does provide, an air-actuated turbine-type vibrator in which the eccentrically weighted rotor has an annular pattern of teeth formed with a regular pattern and spacing of small tooth forms. These tooth forms are of a determined size and configuration commensurate with the size of the rotor and the teeth extend transversely from the side of the rotor. The discharge from the chamber is 90° or 270° from the inlet and is through an end or side wall of the chamber and then an associated muffler.

It is a further object of this invention to provide, and it does provide, an air-actuated turbine-type vibrator in which the air inlet is of a size which is proportioned as to the diameter of the rotor. The outlet is also proportioned as to the diameter of the rotor and is through the peripheral or side wall of the chamber and an associated muffler. The ratio of the inlet to the outlet diameter of the smaller diameter vibrators is about 40 percent of the outlet diameter whereas in the larger diameter rotors the ratio of the inlet to the outlet is about 50 percent.

The air-actuated turbine-type vibrator of this invention, as reduced to practice, ranges from a rotor diameter of 1⅜ inches to a diameter of 5 inches and the number of teeth carried in the annular pattern on and by one side of the rotor ranges from 50 to 100 teeth. The extent and configuration of the tooth forms on the various diameter rotors range from 1/16 to ¼ of an inch depending upon the diameter of the wheel. The air turbine of this invention includes a standard circumferential chamber. The outlet may be from the peripheral wall or the side wall and be disposed about 90° or 270° from the inlet which may be through the peripheral or through the side wall of the chamber. In the various size units the inlet and outlet sizes vary. The outlet may be one or more holes in the side wall of the chamber, these holes leading directly to a muffler associated with the housing. The threaded portion of the inlet terminates at a nozzle bore of about ⅛ to 5/16 of an inch in diameter depending on the size of the unit. The unthreaded portion creates a venturi action prior to the inlet entering the peripheral path of the turbine wheel. The inlet of the silent turbine is of a smaller diameter than is the outlet. The turbine has an eccentric weighted rotor and the eccentric weight is selected as to the amount of vibratory force to be exerted. The teeth in the several embodiments are formed as annular portions of the peripheral portion of the rotor and are generally transverse to the axis of the rotor and may be blade-like or saw-tooth in form. The number of teeth on the rotor is carefully calculated and in actual tests provides the lowest db noise level achievement while providing high r.p.m. output. The air-actuated turbine-type vibrators hereinafter disclosed are contemplated to operate at an air pressure ranging from 30 to 110 p.s.i.

In addition to the above summary the following disclosure is detailed to insure adequacy and aid in understanding of the invention. This disclosure, however, is not intended to prejudice that purpose of a patent which is to cover each new inventive concept therein no matter how it may later be disguised by variations in form or additions of further improvements. For this reason there has been chosen several embodiments of the housing for the "noseless", air-actuated turbine-type vibrator as adopted for use with inlet air pressure of 30 to 110 p.s.i. and showing a preferred means for the construction of the turbine chamber and the blade profile formed on one or both sides of the peripheral portions of the rotor. The several embodiments have been chosen for the purposes of illustration and description as shown in the accompanying drawings wherein:

BRIEF DESCRIPTION OF THE DRAWINGS

In the following description and in the claims various details will be identified by specific names for convenience; these names, however, are intended to be generic in their application. Corresponding reference characters refer to like members throughout the several figures of the drawings.

The drawings disclose certain details of construction but it should be understood that structural details may be modified and that the invention may be incorporated in other structural forms than shown.

DESCRIPTION OF THE EMBODIMENT OF FIGS. 1 AND 2

Figures 1, 2:
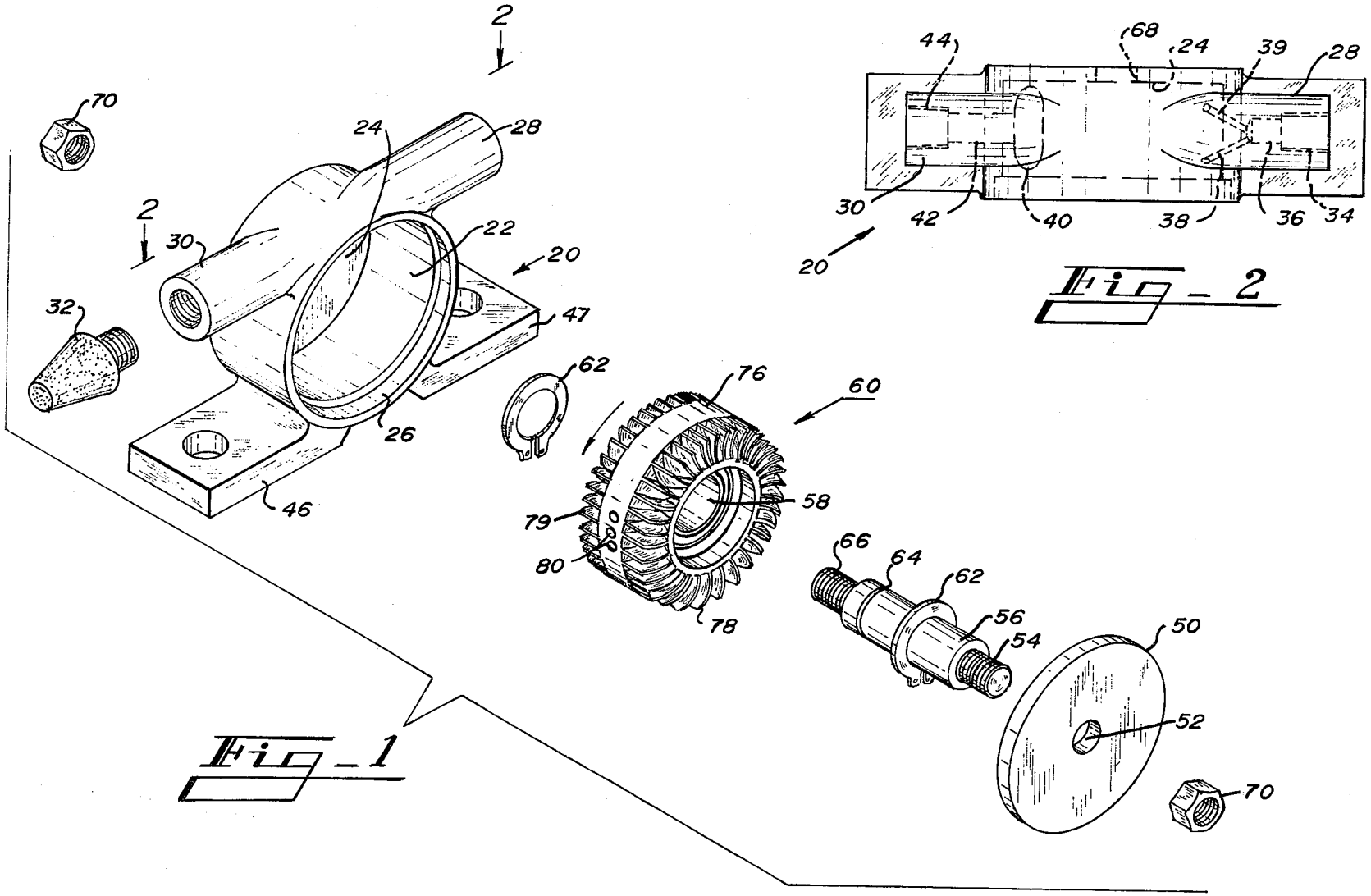
FIG. 1 represents an exploded isometric view and showing the assembly of a turbine-type vibrator in which the turbine blades are arranged as two annular sections on the outer face and rim portions of the rotor, the inlet and outlet in the housing shown are as formed in the chamber peripheral wall.
FIG. 2 represents a plan view of the housing of FIG. 1, the view taken on line 2—2 and looking in the direction of the arrows.

Referring now to the drawings and in particular to FIGS. 1 and 2, there is depicted a housing generally indicated as 20. In this housing the inlet and the outlet are approximately ninety degrees apart and both the inlet and outlet at their entrance and exit to and from the rotor chamber are bifurcated to provide divided inlets and outlets. The input stream is directed toward the outer portions of the rotor chamber formed in the housing. and the output is from the outer chamber portions toward the conductor. As seen particular in FIG. 1, the housing 20 has a circular interior chamber indicated as 22 and a back wall 24. The chamber has an open front in which is formed a shouldered circular recess 26. An inlet boss 28 is seen at the upper right of the housing of FIG. 1 and to the left is an outlet boss generally indicated as 30 and formed therein is a threaded outlet port 44 into which may be mounted either an outlet conductor, not shown, or a porous muffler 32. As seen particular in FIG. 2, the inlet boss 28 has a threaded inlet portion 34 shown in dashed outline. This threaded portion is reduced in diameter to provide a generally circular inlet 36 which is then formed into bifurcated passageways 38 and 39 which direct the inlet flow of air in substantially equal amount to the sides of the circular chamber portion 22. The chamber outlet begins with collector recess 40 which is made sufficiently wide to receive the air after it has engaged the blades of the turbine rotor and from this general collecting portion 40 is directed to a common outlet 42 which is larger than the inlet 36. As the pressurized air expands this greater volume must pass through outlet 42 and then through the threaded portion 44 of the discharge boss portion 30. Legs 46 and 47 are illustrated as one means of mounting the housing 20 to an apparatus or discharge spout to be vibrated.

Figures 3, 9, 10, 14:
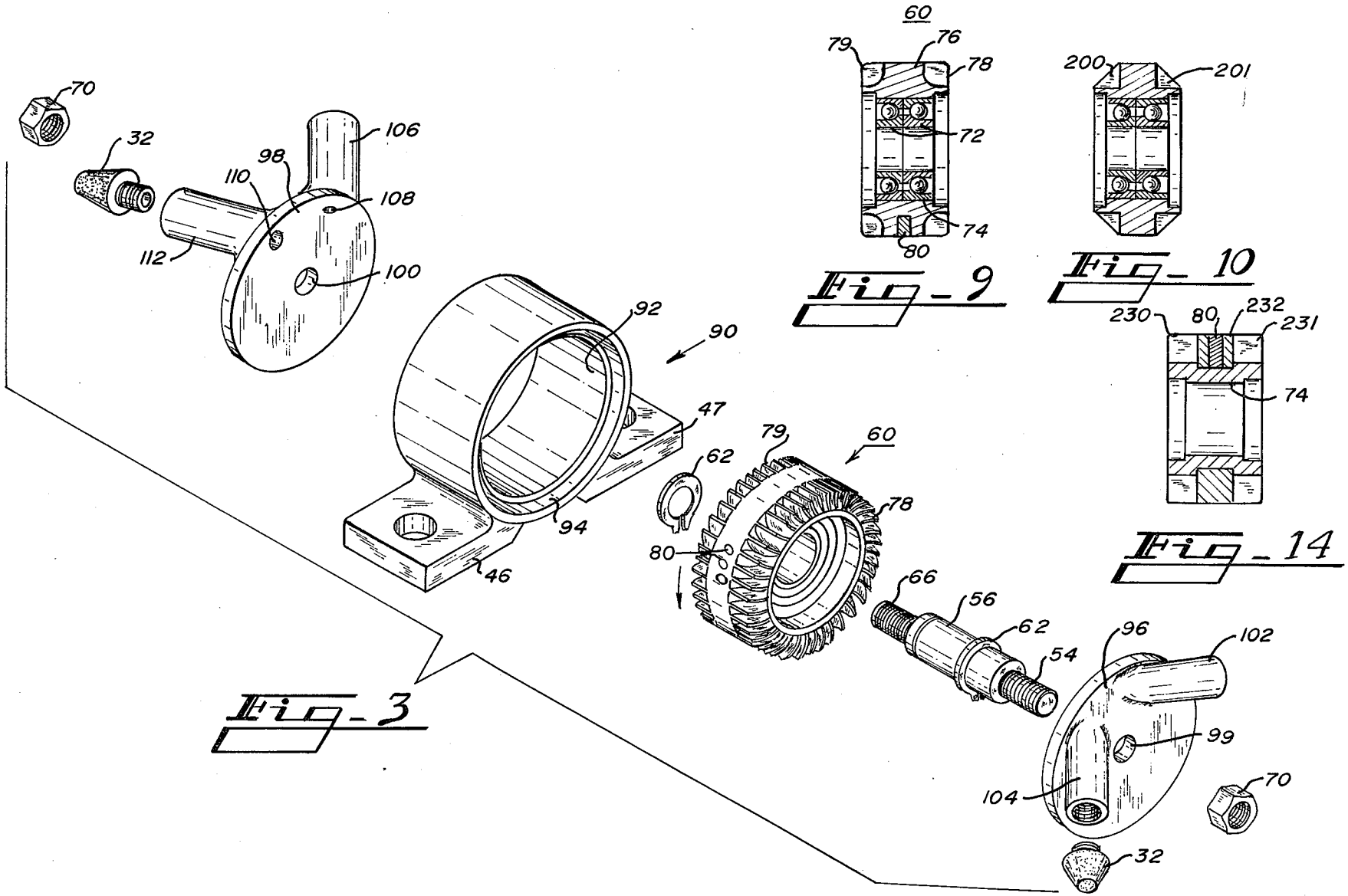
FIG. 3 represents as exploded isometric view of an alternate arrangement whereby the inlet and outlets are carried by and in the side cover plates of the turbine chamber, the inlet and outlet in each being arranged in a V-like pattern and the turbine rotor being substantially identical to that seen in FIG. 1.
FIG. 9 represents a sectional view of an alternate turbine rotor construction in which the outer portions of the blades are formed as with rounded corners.
FIG. 10 represents a sectional view of yet another turbine rotor construction with the blade corners beveled.
FIG. 14 shows a sectional view of an alternate turbine rotor construction in which the blade portions are divided by means of a ring separator.

A front closing disc 50 has its outer diameter sized so as to be a snug fit in circular recess 26 in the housing 20. Centrally positioned in disc 50 is an aperture 52 adapted to receive a threaded end 54 of an axle 56 sized to receive and retain the bore 58 of antifriction bearings 72 carried in a bore of the double-bladed turbine rotor generally indicated as 60. A pair of snap rings 62 is seated in grooves 64 formed in axle 56 and is positioned to retain the turbine rotor 60 centrally in chamber 22. A threaded end 66 passes through an aperture 68 formed in rear wall 24 of the housing 20. Nuts 70 mounted on threaded ends 54 and 66 and tightened secure the turbine rotor 60 in a determined position on the axle 56. This rotor 60, as seen in FIG. 1, is also shown in cross-section in FIG. 9 wherein ball bearings 72 are depicted as carried in a central bore 74 in a turbine rotor casting 76. In addition to the mounted bearings the casting also includes an indication of the configuration of the near ring of turbine blades 78 and far turbine blades 79. The desired number of unbalancing weight inserts 80 are indicated as mounted in the central portion 76 and also are shown in FIG. 9. The weights carried in the center peripheral dividing portion 76 are selected as to number and weight to provide the desired eccentric force in the rotor.

Reference is now made to the performance charts and curves as shown and discussed in my U.S. Pat. Ser. No. 355,681 now U.S. Pat. No. 3,870,282 as filed on Apr. 30th, 1973. To the extent appropriate the information disclosed therein is incorporated by reference in this application. The teeth on the several rotors therein discussed range from 48 diametrical pitch to 24 diametrical pitch. The teeth 78 and 79, as shown in FIGS. 1 and 9, are shallow and are close spaced. The spacing and depth of these annular teeth groupings of the present invention are contemplated to be as close spaced on the smaller rotors as are the teeth of a 48 diametrical pitch gear and on the largest rotors as close spaced as 24 or 20 diametrical pitch. The depth of the blades is shallow so as to reduce the turbulence factor and the resulting noise. The discussion of the size relationship of the inlet to the outlet diameters and the rotor diameter as in the tabulation on page 13 of the reference application also is closely paralleled in the present vibrators of this application.

ASSEMBLY AND OPERATION

Still referring to FIGS. 1, 2 and 9, the housing 20 is formed with a determined sized chamber 22 having a cylindrical configuration. The diameter of the chamber 22 is only slightly larger than the outer diameter of the turbine 60. The width of the turbine 60 is slightly less than the distance between the far wall 24 and the inner face of disc 50 when mounted in the recess 26. The axle 56 is inserted into bore 58 of bearings 72 and the mounted snap rings 62 engage the sides of the bearings to position the rotor on the axle 56. Through the aperture 68 the threaded portion 66 of the axle 56 is inserted and a nut 70 tightened thereon to secure the shaft 56 in a locked condition to rear wall 24. The disc 50 is mounted on the threaded portion 54 of the axle 56 and the near nut 70 is tightened to position and draw the closing disc 50 into a seated engagement in shoulder 26.

An air conduit may be fitted into the threaded portion 34 of the inlet boss 28 and after passing through the inlet diameter portion 36 the pressurized incoming air is divided to flow through passageways 38 and 39 to the outer peripheral portions of the chamber 22. The incoming air engages the closely spaced turbine blades 78 and 79 to cause the turbine, as seen in FIG. 1, to rotate counterclockwise. After passing approximately ninety degrees around the periphery of the chamber 22 the expanded air leaves the blades 78 and 79 to pass into the outlet collecting area 40 and then from this portion flows into the outlet 42 which is larger in diameter than the diameter of inlet conduit 36. From this discharge outlet 42 air is fed to and through the muffler 32 mounted in the threaded portion 44 or through a conduit, not shown, which carries the air to an outside discharge.

VIBRATOR OF FIG. 3

Referring next to FIG. 3, the embodiment shown includes a housing generally indicated as 90 and having a central bore 92 which, as depicted, is open at both ends. Formed at both ends of this bore 92 are like counterbores 94. Mountable in these counterbores are end closure discs 96 and 98 which except for the mirror image relationship of the inlets and the outlets to each other are identical or substantially identical. Formed in and through end member 96 is an aperture 99 adapted to receive and pass the threaded end 54 of axle 56. In end member 98 is formed a like aperture 100 adapted to receive and pass the threaded end 66 of this axle 56. End member 96, as shown, has an inlet boss 102 and an outlet boss 104 as integrally molded portions thereof. If desired they may be attached as by welding, threaded nipples, etc. These bosses are disposed at approximately 30° to the plane of the inner face of the end plate 96. The terminating inner conducting passageway portions of these bosses are radially approximately 90° apart.

In this showing the end closure plate 98 has an inlet boss 106 which is substantially identical to inlet boss 102 and in mounted condition is also substantially a mirror image of boss 102. The discharge passageway inner end through the inlet 106 is identified as 108 and is approximately 90° from the outlet end 110 of the discharge conduit formed in boss 112. Carried within the chamber 92 is the turbine rotor 60 mounted on axle 56 which is arranged in the same manner as described in conjunction with FIGS. 1 and 9 above described. In assembled condition the turbine rotor 60 rotates in a counterclockwise direction as does the rotor 60 in FIG. 1.

ASSEMBLY AND OPERATION OF THE VIBRATOR OF FIG. 3

As in the turbine vibrator of FIG. 1, the housing 90 may have legs 46 and 47 for mounting of the vibrator on the apparatus to be vibrated. The rotor 60 is carried by bearings 72 on the midportion of the axle 56. The rotor is maintained in the desired position on the axle by means of snap rings 62. End plate 96 is secured to the axle 56 by means of nut 70 and is then mounted in the bore 92 for rotating therein when the vibrator is assembled. The other end member 98 is next placed upon the threaded portion 66 of axle 56 and by means of nut 70 the two end plates 96 and 98 are drawn into a tight engaging relationship in the counterbores 94. Prior to the final tightening the inlets 102 and 106 are rotated to the desired orientation which establishes the position of the outlets 104 and 112 since they are fixed in precise relation to the inlets.

Pressurized air or gas is connected to the inlets 102 and 106 by means of a threaded conduit inserted into the bosses 102 and 106. The threaded portions of these bosses are not shown but are conventional in the manner of the inlet 34 of the housing of FIG. 2. The reduced diameter inlet may be compared to the reduced diameter 36 also seen in FIG. 2. The inlet diameter end is in a determined ratio to the diameter of the rotor of the particular vibrator being used. The size of the inlet is generally in accordance with the chart provided in the above-identified application, Ser. No. 355,681. The outlet 110 of end plate 98 is also of a determined larger size than the inlet and a like outlet is provided in boss 104 with the threaded ends of the outlet being adapted to receive the muffler 32 of a threaded discharge conduit, not shown.

In operation the vibrator is mounted to and on the apparatus to be vibrated and pressurized air is fed to and through the bosses 102 and 106 at an established pressure. This inflowing air is directed as a jet stream to engage the blades 78 or 79 and causes the unbalanced rotor to be rotated in a counterclockwise direction and at a contemplated speed. The blades 78 and 79 are of shallow depth and at a close spacing to provide the low noise factor which has been discovered and described in connection with the above-identified applications whose disclosures as applicable are made a part of this description.

This embodiment, in particular, provides means for the inlet and outlet to direct and collect the flow of air to and from turbine blades. These connecting bosses are provided by external members not directly connected to the housing 90. It is to be noted that the inlet and outlet bosses 102, 104, 106 and 112 may be positioned from each other at other than ninety degrees. Also the inlet and outlet may be disposed on the end plates at other than the suggested or anticipated thirty degrees. The degree of angle is a matter of preference, however, the inlet and outlet should be disposed at an angle not greater than sixty degrees so that the impingng force of the air upon the turbine blades is efficiently derived by the directed jet force.

VIBRATOR OF FIG. 4

Figures 4, 5, 7, 8:
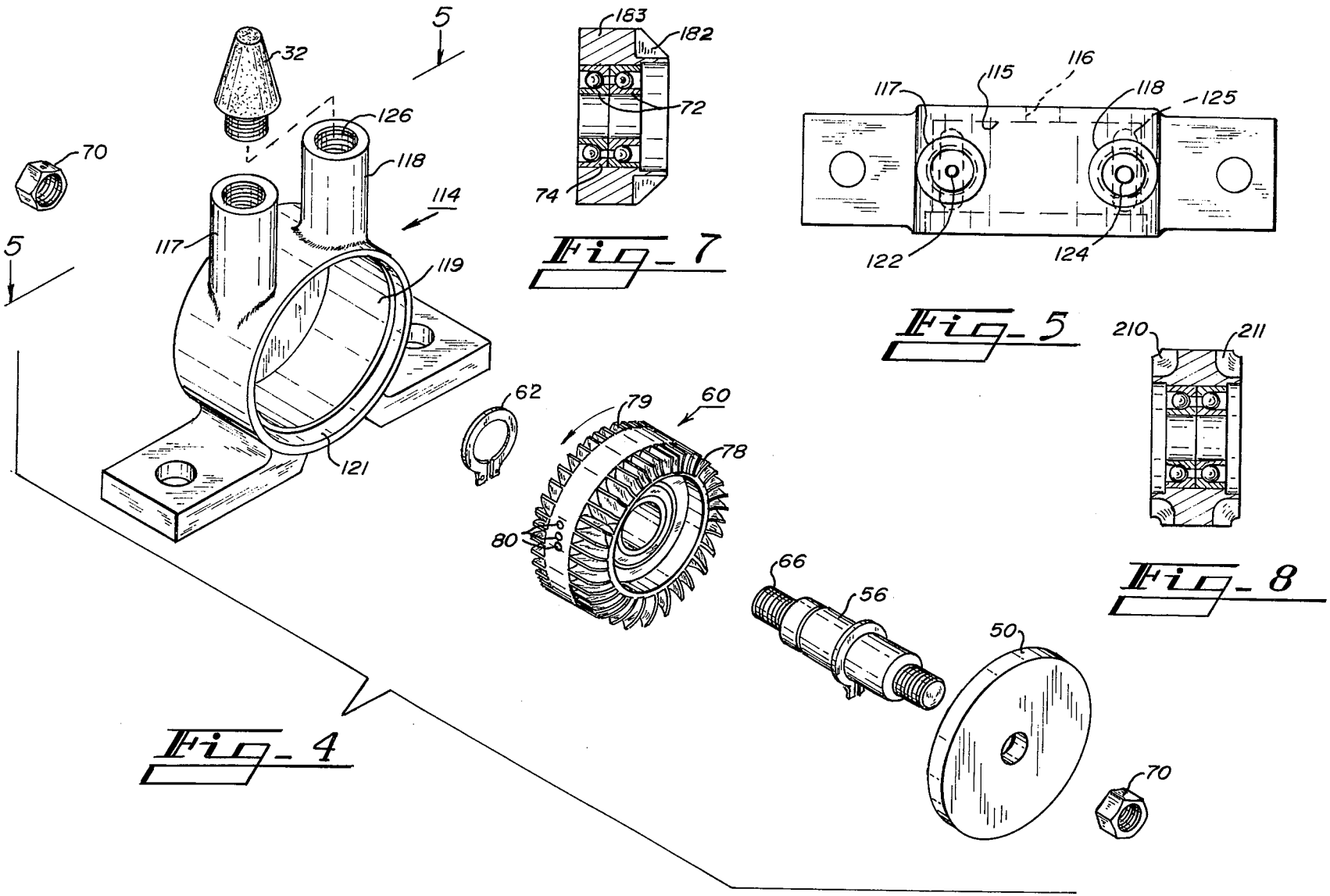
FIG. 4 represents an exploded isometric view of a turbine substantially like that of FIG. 1 but with the inlet and outlet arranged so that the flow pathway in the chamber is approximately 270°.
FIG. 5 represents a plan view of the tubine housing member of FIG. 4, this view taken on the line 5—5 and looking in the direction of the arrows.
FIG. 7 represents a sectional view of a turbine rotor having its annular blade portion disposed only on one side.
FIG. 8 represents a sectional view of a turbine rotor with the turbine blade portions formed on each of the outer corner portions of the rotor providing two annular rows of blades.

Referring next to the embodiment of FIG. 4, there is provided a housing 114 whose chamber may have a back wall 115 in which is formed an aperture 116 sized to receive the threaded end 66 of an axle 56. An inlet boss 117 is carried at the near side of the housing 114 and an outlet boss 118 is carried at the far end of the housing with the inlet and the outlet entrances to chamber 119 disposed approximately 270° from each other. The chamber portion of the housing is provided by the bore 119 whose near side has a counterbore 121 adapted to receive the end member 50, as previously described. As seen in FIG. 5, in the plan view of the housing 114 an inlet 122 as formed in the boss portion 117 is much smaller than outlet 124 formed in outlet boss 118.

USE AND OPERATION OF THE VIBRATOR OF FIG. 4

The back wall 115 may be an inserted disc 50 if the wall is not cast integral with the housing. The inlet 117 has a reduced inlet 122 whose determined diameter is commensurate with the diameter of the rotor as above discussed and the size and spacing of the blades of the rotor 60, as identified as 78 and 79, are close spaced and arranged in an annular patter as above-described. The inlet 122 is bifurcated to present two jet streams, one directed against the blades 78 and the other against the blades 79. After approximately 270° of travel through the turbine chamber 119 a collector portion 125 receives the expanded air and directs this air into the outlet portion 124 formed in the boss 118. As depicted, the rotor 60 rotates in a counterclockwise direction. The muffler 32 may be mounted in the threaded bore 126 of the boss 118 or a conductor, not shown, may be attached thereto for carrying the air to areas other than the environment within which the vibrator operates.

VIBRATOR OF FIG. 6

Figures 6, 11, 12, 13:
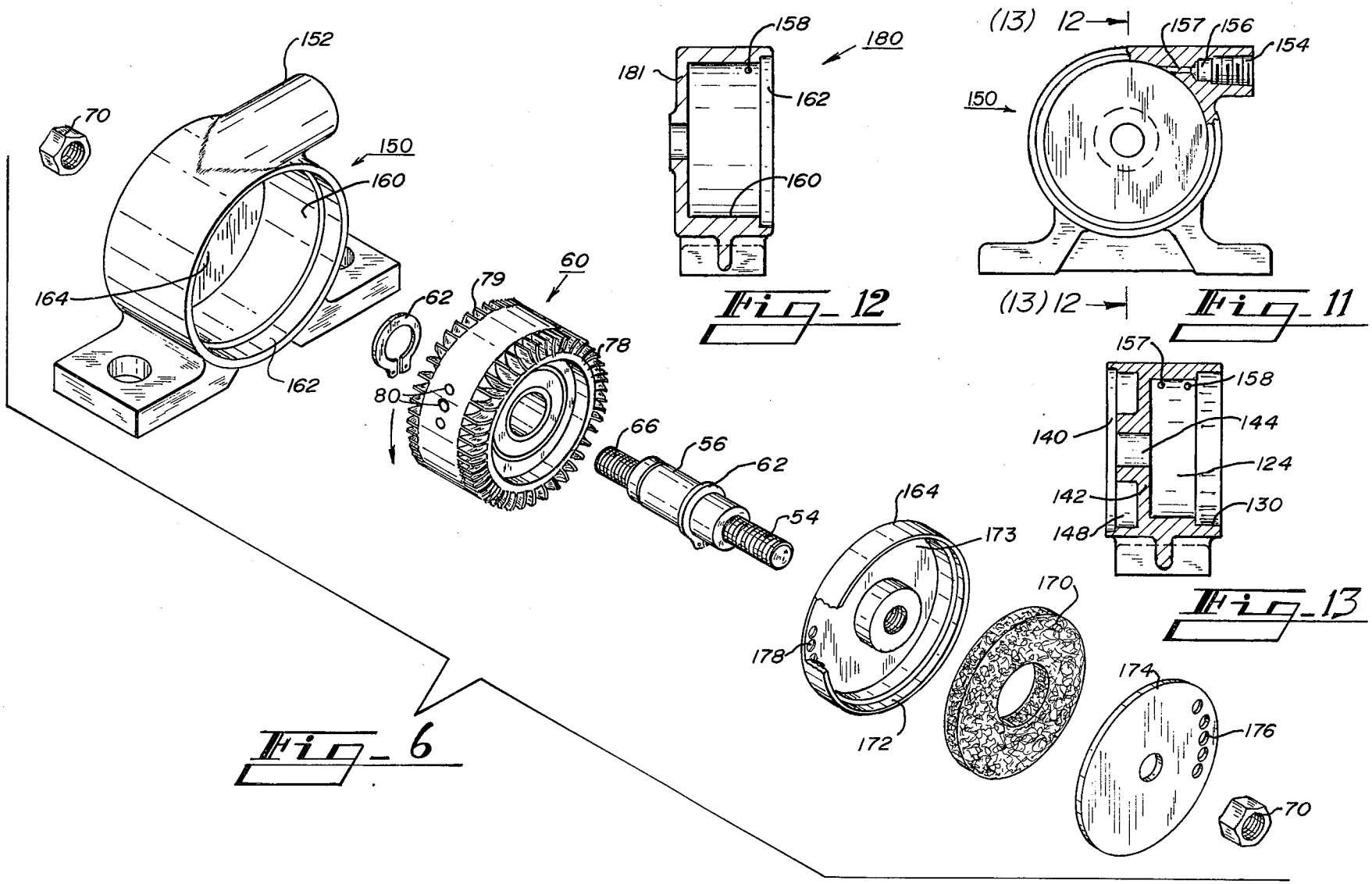
FIG. 6 represents an exploded isometric view of yet another turbine-type vibrator in which the rotor of FIG. 1 is used with a housing in which is mounted a ring-like muffler which receives the discharged air from the rotor chamber.
FIG. 11 represents a side view of the turbine of FIG. 6 with a portion partly in section to show the inlet portion of the housing.
FIG. 12 represents a sectional view of a turbine housing such as in FIG. 11 with the view taken on the line 12—12 and looking in the direction of the arrows.
FIG. 13 represents a sectional view of a turbine housing like that of FIG. 12, this housing adapted for a turbine rotor having two annular blade sections.

Referring next to the vibrator of FIG. 6, there is depicted a housing 150 having an inlet boss 152 in which is formed a threaded opening 154 which joins a reduced diameter 156 terminating at bifurcated reduced inlets 157 and 158 as seen in FIGS. 11 and 13. Housing 150 may be made with a through bore 160 each of whose ends are formed with a counterbore. These counterbores 162 are sized to receive end ring members 164 or as an alternate as seen in FIG. 12, a plain back wall 166 may be provided. The end walls of the chamber are selected as to whether the chamber is to have a rotor with two rows of blades such as rotor 60 depicted in FIG. 6 or as a rotor 178 having a single row of blades in the sectional view of FIG. 7.

Assuming that the rotor 60 of FIG. 6 is to be used, there are provided two end members 164 in each of which is mounted a ring-like muffler 170. In this recess portion of the end member 164 is a counterbore 172 in which is mounted end plate member 174. End member 174 has a plurality of outlet holes 176, the purpose and use of which is described in the reference application Ser. No. 430,082 and in which the disc-type muffler is thoroughly described. In the end member 164 is provided a plurality of inlet discharge ports 178.

ASSEMBLY AND OPERATION OF THE VIBRATOR OF FIGS. 6, 11 AND 13

Assuming that a rotor 60 having two blades 78 and 79 is to be used with this vibrator, the rotor 60 is mounted on axle 56 in the manner above-described. Snap rings 62 retain the rotor on the axle in the desired position. End member 164 is mounted on the threaded end 54 of the axle 56 and the muffler member 170 is placed in the muffler receiving chamber portion 173. The end plate 174 is then placed in the counterbore 172 with the apertures 178 disposed approximately 180° from the apertures 176. This end member assembly is now positioned in the chamber so that the apertures 178 are approximately or more than 90° downstream radially from the stream input outlets 157 and 158. A far housing identical to the near housing 164 but in a mirror image relationship thereto is provided as a closure for the far end of the chamber 160 and the two end members are tightened in place by means of the nuts 70.

In operation the pressurized air is brought in through a conduit mounted in the threaded portion 154 and then through the reduced portion 156 and into the bifurcated input outlets 157 and 158. The resulting impinging jet streams of pressurized air are directed against the blades 78 and 79. Their force drives the blades causing rotation of the rotor 60 at a selected speed within the chamber 160. After the expanded air has travelled for approximately, or a little bit more than 90° within the chamber the expanded air is fed out through the apertures 178 and the muffler ring 170 and finally through the discharge apertures 176 in plate 174.

ALTERNATE TO THE VIBRATOR OF FIG. 6

As seen in FIGS. 7 and 12 is an alternate vibrator which does not require two rows of blades. As an illustration of such an assembly FIG. 12 shows a housing 180 made with an integral back wall 181. Inlet 154 has only one outlet 158 which directs the input pressurized air against a row of blades 182 as formed on one side of a rotor 183. Bearings 72 are mounted in a bore 74 in the rotor. A single muffler such as is provided by the near end member 164, the muffler ring 170 and the end plate 174 is as shown in FIG. 6. When tightened in place rotor assembly 183 rotates as does the rotor 60 and the exhaust of the air operates in the same manner as the vibrator of FIG. 6.

In FIG. 13 an alternate form of the housing of FIG. 6 is shown as havng an integral back wall rather than an end member 164. A shoulder 140 is adapted to receive an end plate 174 while integral wall 142 provides the inner left wall of a cavity 124. Bore 144 is adapted to receive and retain the threaded end 66 of axle 56. Recess 148 receives a muffler ring 170. A seating counterbore 130 receives a ring 164. Assembly of this housing proceeds as described in FIG. 6 above.

THE VARIOUS ROTOR CONSTRUCTIONS

It is assumed that all rotors will have at least one annular ring of blades and these blades are selected as to their spacing and depth in relation to the diameter and the desired eccentric weight of rotors used with a particular vibrator. The rotor blades are about 1/16 of an inch from the outer diameter walls of the chamber and the end plates are also about 1/16 from the rows of blades. As reduced to practice, this spacing of the rotor blades to the end and side walls provides the maximum rotation of the rotor.

The blades may have a small outer radius as seen in FIG. 9 and where the blades are attached the juncture with the body of the rotor body may also be a radius. It is to be noted that at the juncture fillets are generally provided to reduce the turbulence of air in the blade pockets to the very minimum. This reduces the noise level produced by the blades as they receive the air from the input jets. In FIG. 10 it is to be noted that the blades 200 and 201 are beveled at 45° although any other degree of bevel may be made on a more-or-less right-angled basis as shown. The depth and spacing of the blades, of course, are established in accordance with the size of the rotor. In FIG. 8 it is to be noted that blade portions 210 and 211 are configured with arcuately contoured corners which may reduce air turbulence in the chamber. These blades are also shown as joining the body in an arcuate configuration. It is to be noted that in FIG. 14 teeth 230 and 231 are transversely cut and a ring portion 232 provides the inner shoulder for the blades so that the incoming air and the exiting air is confined to a very narrow path as it is conducted within the chamber. The recesses at the ends of the bearing bore 74 provide spaced for the mounting and retaining of the snap rings and also provide an air cushion to prevent turbulent action.

The several embodiments above-described show rotors having one or two annular rings of blades. The housings used therewith have air or gas inlets which are so directed as to engage the blades at a shallow angle to drive the rotos at the desired speed and rotation. The several housings depict expanded air removal after about 90° or 270° of chamber travel. These embodiments are merely exemplary and are not intended to be limting as it is readily apparent that the radial relationship of the input to the output is merely a matter of convenience. Whether the bosses are cast integral or are attached by welding, threaded connection or the like is also merely a matter of selection.

The teeth spacing and depth is proportional to the diameter and width of the rotor and to maintain the silent characteristics the spacing and depth follow much the chart of the standard vibrator design as disclosed on Page 13 of the application, Ser. No. 355,681 above noted. The inlet and outlet size also follow these same general design parameters.

Terms such as "left," "right," "up," "down," "bottom," "top," "front," "back," "in," "out," "clockwise," "counterclockwise" and the like are applicable to the embodiments shown and described in conjunction with the drawings. These terms are merely for the purposes of description and do not necessarily apply to the position in which the noiseless vibrator may be constructed or used.

While particular embodiments of the vibrator, housings and rotors have been shown and described it is to be understood the invention is not limited thereto and protection is sought to the broadest extent the prior art allows.

What is claimed is:

1. A relatively silent, compressed gas-actuated, turbine-type vibrator having a rotor of not less than 1¼ inches and not more than 5½ inches diameter and when operated within a speed range of 6,000 to 10,000 rpms having a noise level not greater than 85 decibels hz., the vibrator including: (a) a substantially closed housing having a cylindrical chamber therein; (b) a dynamically unbalanced rotor freely rotatable in the cylindrical bore of the chamber, the diameter and length of the rotor being established so that not less than one thirty-second of an inch clearance is provided between the rotor and ends and bore of the chamber, the rotor having a plurality of tooth-like configurations formed on its outer periphery, the tooth-like configuration further having a radial depth which corresponds to a distance not exceeding 7 percent and not less than 1½ percent of the diameter of the rotor, these tooth-like configurations form blades of substantially identical configurations disposed on at least one of the two sides of the rotor and arranged in an annular pattern and extending from its outer periphery a short distance inwardly to terminate short of the other side of the rotor, these teeth disposed at substantially right angles to the plane or rotation of the rotor; (c) an air outlet formed in the housing and extending from the rotor chamber to the outside of the housing, and (d) an air inlet formed in the housing and extending from the outside of the housing to the rotor chamber, the air inlet arranged to carry this air to at least one side of the rotor chamber and to direct the incoming pressurized air tangentially against the teeth of the mounted rotor and with the tooth-like configuration so formed that in a plane normal to the axis of the rotor the face of the tooth-like configuration against which the incoming air impinges defining an angle of intersection with a theoretical radial line of said rotor, said defined angle being as little as zero and as great as 30° as measured from said point of intersection and inclined in such a direction that the circumferential thickness of the tooth-like configurations tend to decrease as the radial distance from the axis increases, the cross-sectional area of the inlet being 30 to 55 percent of the area of the outlet.

2. A relatively silent, air-actuated vibrator as in claim 1 in which the rotor is formed with one annular row of blades and there is one air inlet and one air outlet into and from the rotor chamber.

3. A relatively silent, air-actuated vibrator as in claim 1 in which the rotor is formed with two annular rows of blades and there is provided a barrier portion therebetween and in which the incoming pressurized air is directed into the rotor chamber as two separated streams with one stream being directed toward one row of blades and the other stream directed toward the other row of blades.

4. A relatively silent, air-actuated vibrator as in claim 3 in which the incoming air is received by a common conductor and then is bifurcated to provide separate driving streams and the outlet includes a collector recess which receives the expanded pressurized air from both streams and carries it from the chamber.

5. A relatively silent, air-actuated vibrator as in claim 4 in which the collector recess leads to and into a single outlet conductor.

6. A relatively silent, air-actuated vibrator as in claim 5 in which the outlet for an annular row of blades is about 90° subsequent to the inlet.

7. A relatively silent, air-actuated vibrator as in claim 2 in which the outlet is through apertures in a side wall of the rotor chamber and then through a ring-like muffler carried in an attached muffler chamber and thence out an end plate having outlet holes, this end plate providing an outer cover for the muffler chamber.

8. A relatively silent, air-actuated vibrator as in claim 2 in which the inlet and the outlet are carried in an end cover plate.

9. A relatively silent, air-actuated vibrator as in claim 3 in which there are two inlets and two outlets so arranged that one inlet and one outlet are carried in an end closure disc forming one end wall of the rotor chamber and the other inlet and outlet are carried in a like end closure disc forming the other end wall of the rotor chamber.

10. A relatively silent, air-actuated vibrator as in claim 3 in which the air is received by a common conductor and then bifurcated to provide separate driving streams and there are two outlets each through a side wall adjacent the annular row of blades, each outlet through a side wall member of the muffler chamber and then through a ring-like muffler carried in an attached muffler chamber then out an outer end plate having outlet holes and providing the outer cover for this muffler chamber.

11. A relatively silent, air-actuated vibrator as in claim 5 in which the outlet from the rotor chamber for an annular row of blades is about 270° subsequent to the inlet to said chamber.

12. A relatively silent, air-actuated vibrator as in claim 11 in which the inlets and outlets are formed through the wall of the rotor chamber.

* * * * *